United States Patent [19]

Andrews et al.

[11] Patent Number: 4,711,390

[45] Date of Patent: Dec. 8, 1987

[54] COLLAPSIBLE BOX FOR TRASH COMPACTING SYSTEM

[75] Inventors: Kenneth E. Andrews, Rancho Palos Verdes, Calif.; Gary Weingardt, Las Vegas, Nev.; James L. Durbin, Valencia, Calif.

[73] Assignee: A.K.G.S., Las Vegas, Nev.

[21] Appl. No.: 868,131

[22] Filed: May 28, 1986

Related U.S. Application Data

[63] Continuation-in-part of Ser. No. 635,141, Jul. 27, 1984, Pat. No. 4,620,479.

[51] Int. Cl.[4] ..... B65D 5/36

[52] U.S. Cl. ..... 229/41 R; 229/23 R; 229/125; 229/907

[58] Field of Search ..... 229/41 R, 41 B, 23 R, 229/125, 907, 138, 137; 383/62; 100/229 A

[56] References Cited

U.S. PATENT DOCUMENTS

| | | | |
|---|---|---|---|
| 284,179 | 9/1883 | Buckingham | 229/41 B |
| 715,026 | 12/1902 | Crawford | 229/41 B |
| 1,374,473 | 4/1921 | Scotcher | 229/41 B |
| 2,281,165 | 4/1942 | Miller | 229/41 B |
| 2,582,502 | 1/1952 | Nagler | 229/125 |
| 2,861,735 | 11/1958 | Faltin | 383/62 |
| 3,334,802 | 8/1967 | Gooding | 229/137 |
| 3,373,919 | 3/1968 | Schaich | 229/125 |
| 3,439,866 | 4/1969 | Kuhnle | 206/620 |
| 3,850,362 | 11/1974 | Stollberg et al. | 229/41 B |
| 4,300,716 | 11/1981 | Jennings | 229/138 |

FOREIGN PATENT DOCUMENTS

| | | | |
|---|---|---|---|
| 302849 | 12/1928 | United Kingdom | 229/41 B |
| 1571991 | 7/1980 | United Kingdom | 229/41 R |

*Primary Examiner*—Stephen Marcus
*Assistant Examiner*—Gary E. Elkins
*Attorney, Agent, or Firm*—Fulwider, Patton, Rieber, Lee & Utecht

[57] ABSTRACT

This invention is directed to an improved collapsible box for trash compactors and particularly aircraft trash compactors. The box is constructed from an integrally formed elongated main section having rectangularly shaped front, rear, and bottom panels and a pair of opposing side panels which are secured to continuous flanges hingedly connected to the vertical edges of the front and rear panels and to the horizontal edges of the bottom panel.

At least one side panel is provided with a free-standing edge which is adapted to be seated in a guide or securing means or overhang within the compactor chamber which fixes the position of the side panel.

A continuous medial fold line is provided at the middle of the front, rear, and bottom panels to facilitate the folding of the box into a collapsed state for storing. In the preferred embodiment, the front and rear panels are each provided with a pair of fold lines which extend from the lower edges of the panels to common points on the medial fold lines. These fold lines allow the front and rear panels to fold inwardly and the bottom panel to fold outwardly about the medial lines thereof.

8 Claims, 9 Drawing Figures

FIG. 1
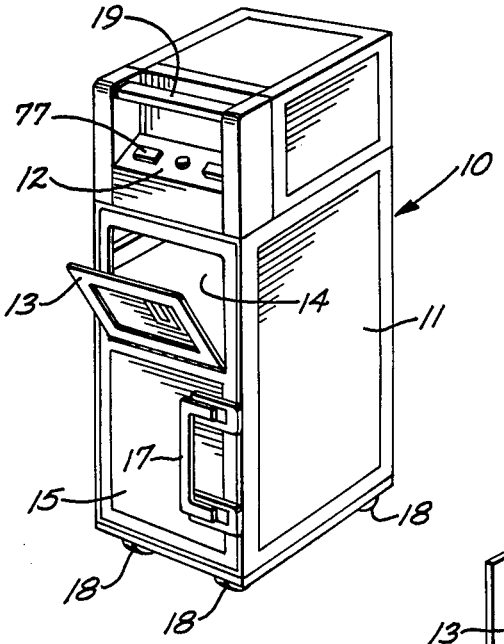
FIG. 2
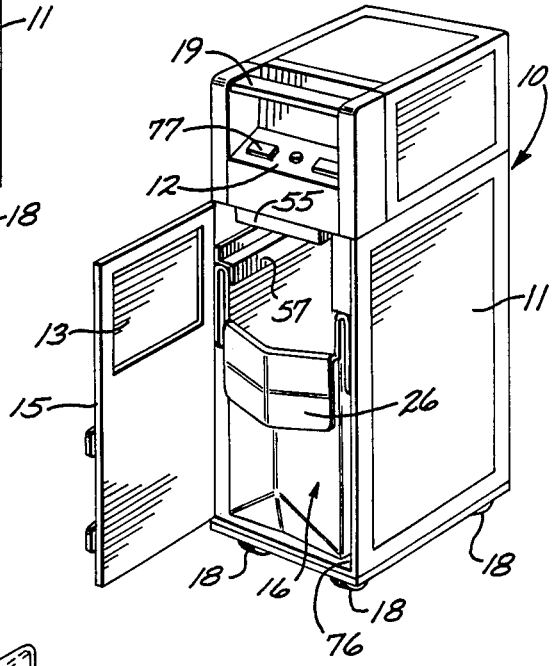
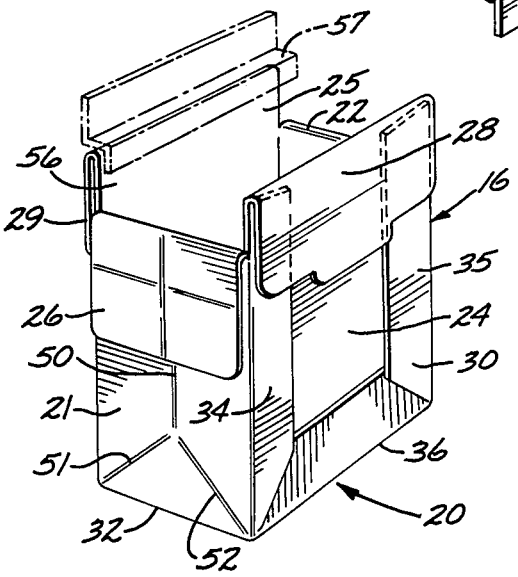
FIG. 3

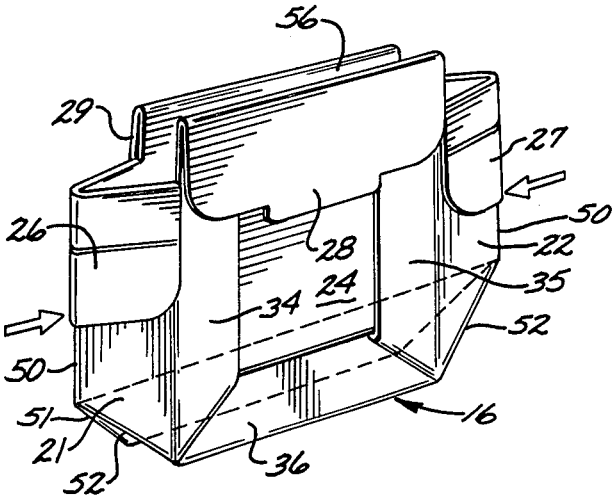
FIG. 4
FIG. 5
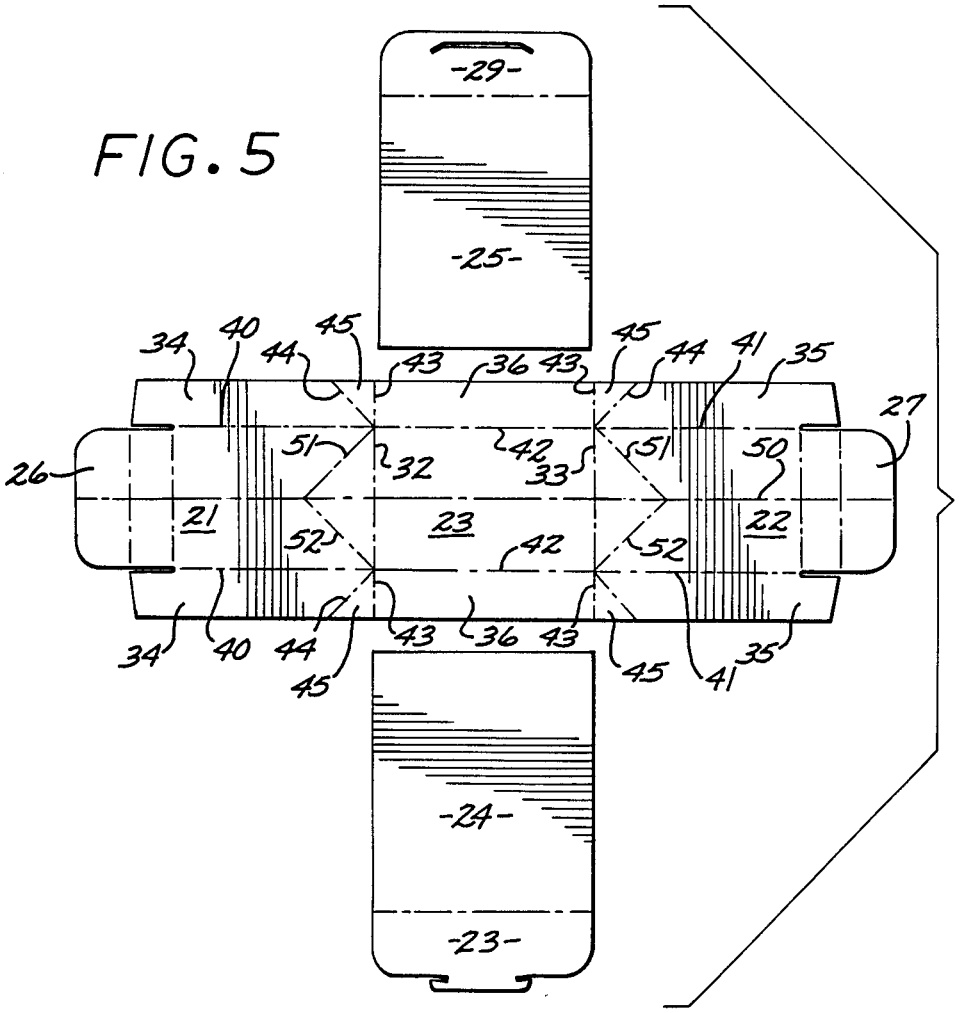

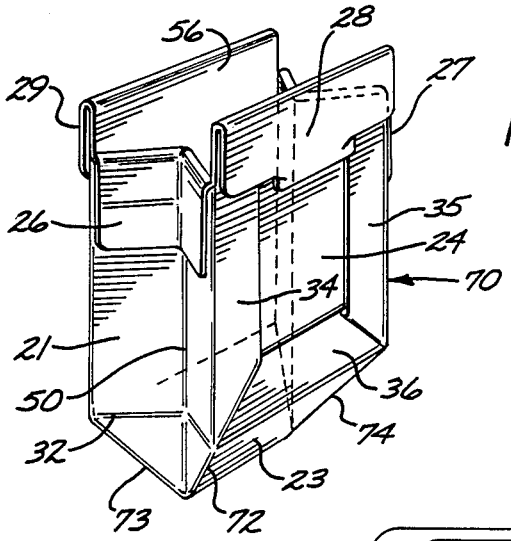
FIG. 8
FIG. 9
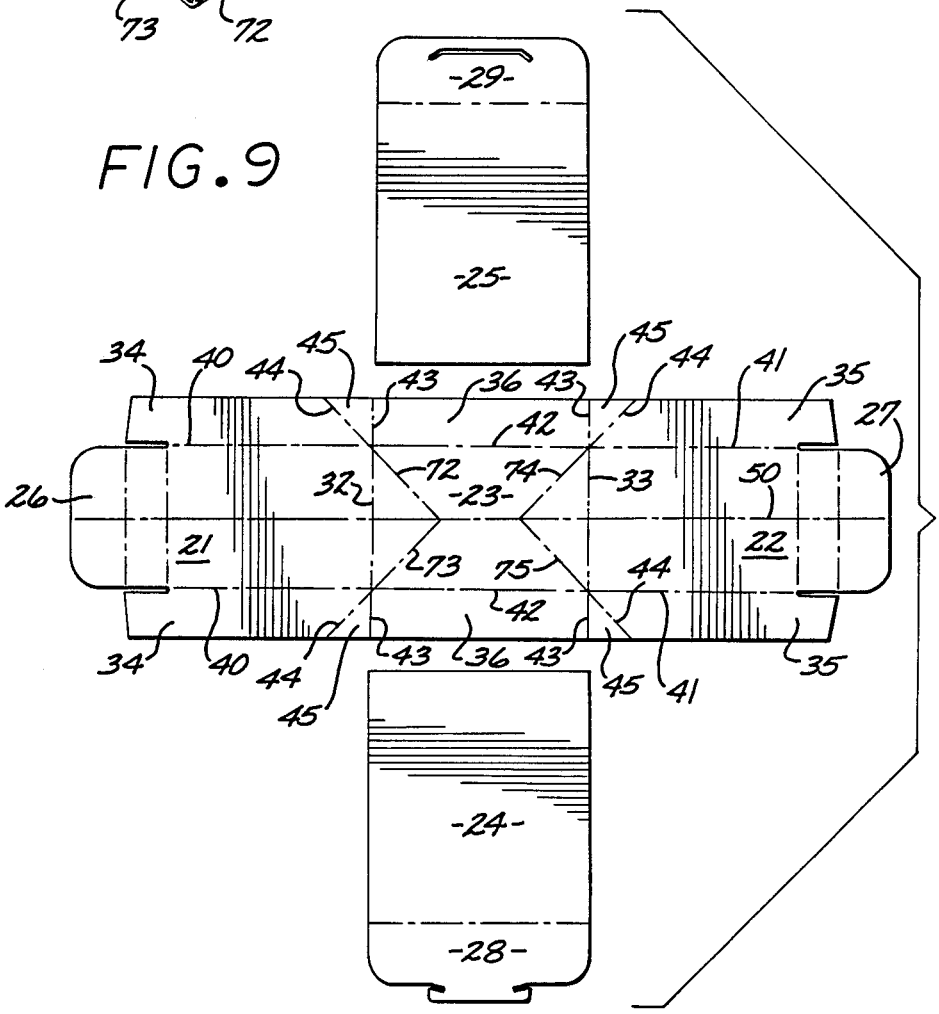

COLLAPSIBLE BOX FOR TRASH COMPACTING SYSTEM

This application is a continuation-in-part of application Ser. No. 635,141, filed on July 27, 1984, now U.S. Pat. No. 4,620,479, issued 11/4/86.

BACKGROUND OF THE INVENTION

This invention generally relates to a trash compactor system and particularly a collapsible box suitable for use in an aircraft trash compactor system.

Most of the containers used in residential trash compactors have heretofore been paper or plastic bags. While such containers are satisfactory for residential use, they have not been found very suitable in commercial and aircraft compactor installations where very high compacting pressures tend to tear the paper or plastic bags.

Cardboard or fiberboard boxes have been found to provide suitable strength to withstand the high compacting pressures characteristic of commercial and aircraft compactors, but there has been a considerable difficulty in designing a collapsible box which can be easily opened up and placed in the trash compactor chamber so that the box is properly aligned with the compacting piston or platen. Collapsible cardboard and fiberboard boxes have a tendency when opened up to spring back to a slightly closed condition. As a result of this tendency to take a slightly closed position when the trash boxes are placed within the compacting chamber of the compactor, the box will not be properly aligned with respect to the compacting platen of the compactor. On the down or compacting stroke of the platen it will frequently engage the sides of the trash box severely damaging the container and limiting the usefulness thereof.

Another problem, which is characteristic of aircraft compactors, involves the compacting of trash containing significant quantities of fluid. Under the very high compacting pressures characteristic of the aircraft compactors (e.g., up to 80 psi or more), the fluid within the trash tends to leak through the seams and corners even when the cardboard or fiberboard material of the box has been suitably treated to be waterproof.

Thus, a substantial need remains for a collapsible box which can be stored in a flattened condition and which can be easily opened up and inserted into a trash compactor so that the box is properly aligned within the compacting chamber. Moreover, there is a need for a cardboard or fiberboard box which does not readily leak fluid when fluid-containing trash is compacted therein.

The trash compactor box and system of the present invention satisfies these needs.

SUMMARY OF THE INVENTION

The present invention is directed to an improved collapsible box for a trash compactor system and particularly to a collapsible box which is adaptable for use in an aircraft trash compactor system such as those described in copending applications Ser. No. 635,141, filed July 27, 1984, and Ser. No. 781,391, filed on Sept. 26, 1985.

The collapsible box in accordance with the present invention generally comprises an integrally formed elongated main section having a rectangularly shaped bottom panel and upstanding, rectangularly shaped front and rear panels which are hingedly connected by means of a seamless fold to the front and rear edges or margins, respectively, of the bottom panel. Each of the opposing long sides of the main section are provided with a continuous, integrally formed, inwardly folding flange which extends along and is hingedly connected to the sides of the front, rear, and bottom panels by means of a seamless fold. A pair of opposed side panels are secured to the inner sides of the two inwardly folding continuous flanges.

The rear, front, and bottom panels which form the elongated main box section, are provided with a continuous medial fold line or crease along the length of the main section to facilitate the collapsing of the box into a flattened state for storage.

In a preferred embodiment of the invention, both of the front and the rear panels are provided with a pair of diagonal fold lines extending from the lower corners of the panels at the junction with the margin of the bottom panel to a common point on the medial fold line on the respective panels. This construction allows the front and rear panels to fold inwardly about the medial fold line and the bottom panel to fold outwardly about the medial fold line when the box is collapsed into a flattened condition for storage.

In another embodiment of the invention, the bottom panel is provided with two pair of diagonal fold lines which extend from adjacent corners of the panel to common points on the medial fold line of the panel. This construction allows the bottom panel to fold inwardly about the medial fold line and the front and rear panels to fold outwardly about the medial fold line thereof when the box is collapsed into a flattened condition for storage.

Each of the lower portions of the flange sections which are hingedly connected to the side margins of the front and rear panels are provided with a pair of fold lines which originate at the corner intersection of these panels with the corners of the bottom panel to define triangularly shaped flange segments which are folded over onto adjacent portions of the same flange section when the front and rear panels are folded in an upright position with respect to the bottom panel. The exposed face of the triangularly shaped segment is secured by suitable adhesive to the flange section connected to the side margin of the bottom panel. This construction provides a seamless fold completely around the intersection of the bottom panel with the front and rear panels and with the flanges connected to the side margins of the bottom panel so as to minimize fluid leaks during the compacting of fluid containing trash therein.

In a preferred embodiment, at least one of the side panels of the box is provided with a free-standing edge which is adapted to fit under or into a guide or securing element or overhang provided on the inside wall of the compacting chamber of the trash compactor to fix the position of the one side of the opened box therein. This embodiment is particularly suitable with the preferred box construction wherein the front and rear panels of the trash box fold inwardly about the medial fold line. When the opened box is placed on the compacting chamber the edge of the side member of the box is fixed by the guide means. The rear box panel is completely opened up when the partially folded edge thereof is pushed against the back wall of the chamber when the box is placed in the chamber. The front panel is urged completely open by the inside of the front door when the door is closed. In this manner, the box is completely open and properly aligned with respect to the platen so that there is little chance of the platen contacting the upstanding panels of the box during compaction. Moreover, with the trash box completely open, there is less chance of trash falling between the box and the chamber walls.

When the trash box is full, the front door of the compactor is opened and the compactor box is pulled from the chamber. Closure flaps, which are preferably provided along the outside of the compactor box, are folded over the top thereof to facilitate closing and may be taped, glued, or otherwise secured in a closed position to enable the trash compactor box to be transported to another area for disposal without loss of its contents.

These and other advantages of the invention will become more apparent when taken in conjunction with the following detailed description of the invention and the accompanying exemplary drawings.

BRIEF DESCRIPTION OF THE DRAWINGS

FIGS. 1 and 2 are perspective views of a trash compactor system embodying features of the invention;

FIG. 3 is a perspective view of a collapsible trash compactor box which embodies features of the invention shown with the compactor system of FIG. 2;

FIG. 4 is a perspective view of the trash compactor box shown in FIG. 3 in a partially opened condition;

FIG. 5 is a plan view of the blank from which the trash compactor box of FIG. 3 is manufactured;

FIG. 8 is an alternative trash compactor box construction which embodies features of the invention; and FIG. 9 is a plan view of a blank from which the trash compactor box shown in FIG. 8 was constructed.

DETAILED DESCRIPTION OF THE INVENTION

Figure 6:
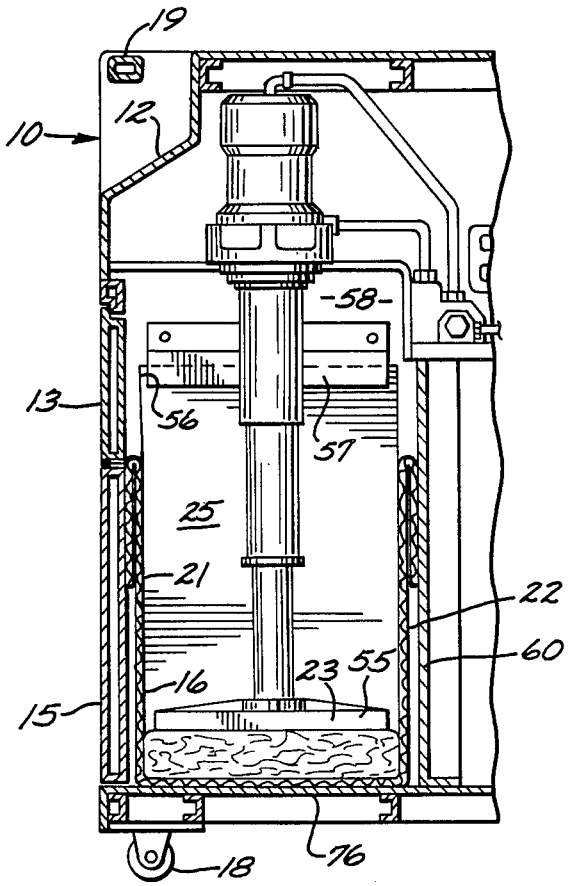
FIG. 6 is a cross-sectional view of the trash compactor system shown in FIG. 1 taken along the lines 6—6.
Figure 7:
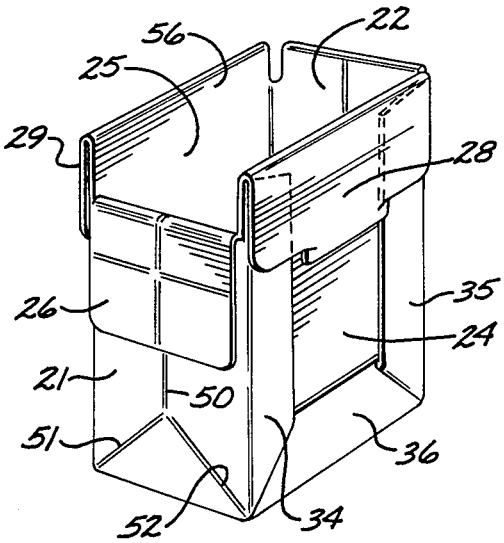
FIG. 7 is a perspective view of an alternative trash compactor design which embodies features of the invention.

Reference is made to FIGS. 1 and 2 which are perspective views of a trash compactor system embodying features of the invention. As shown in these figures, the compactor 10 generally comprises a housing or cabinet 11 which has a control panel 12, a chute 13 for feeding trash into the compacting chamber 14 in the housing 11 and a door 15 in the front of the housing 11 to facilitate loading and unloading trash compactor containers or boxes 16. The door 15 is provided with a latch 17 for opening and closing thereof. The particular embodiment shown in FIGS. 1 and 2 is designed to be portable and is provided with wheels 18 on the lower portion thereof and with a handle 19 to facilitate moving the compactor 10 to desired locations. The door 15 on the front of the cabinet 11 is pivotally mounted along one side thereof by means of hinges (not shown) in order to install and remove trash containers 16. Preferably, suitable interlocks (not shown) are provided on the chute 13 and the door 15 to ensure that the compactor 10 is inoperable unless both the door 15 and chute 13 are closed.

A preferred embodiment of the trash compactor box 16 illustrated in detail in FIGS. 3, 4, and 5, generally comprises a main section 20 with integrally formed front panel 21, rear panel 22, bottom panel 23, and opposing side panels 24 and 25. The front panel 21, rear panel 22 and side panels 24 and 25 are each provided with closure flaps 26, 27, 28 and 29, respectively, to facilitate closing the box after use thereof.

The main section of the box 16 is provided with a pair of continuous, inwardly folding flanges which are formed integrally with and hingedly connected to the sides of the front panel 21, rear panel 22, and bottom panel 23. Side panels 24 and 25 are secured, usually by an adhesive, to the inner sides of flanges 30.

The blanks from which the trash compactor box 16 is constructed is illustrated in FIG. 5. The main section 20 is a single piece of cardboard, fiberboard, or other suitable material. The front panel 21 is hingedly connected to the bottom panel 23 through a fold 32. The rear panel 22 is similarly hingedly connected to the bottom panel 23 by means of a fold 33. The inwardly folding, continuous flanges 30 are integral parts of the one-piece main section 20 and each flange comprises sections 34, 35, and 3 which are hingedly connected to the front panel 21, rear panel 22, and bottom panel 23, respectively, by means of seamless folds 40, 41, and 42, respectively.

Each of the flange sections 34 and 35 connected to the front and rear panels 21 and 22 is provided on the lower section thereof, adjacent to the bottom panel 23, with a pair of folds 43 and 44 which originate at the corners of the bottom panel 23 and extend outwardly to the edge of the flange section. Fold 43 extends transversely and fold 44 extends diagonally to defne a triangularly shaped segment 45 which, when the panels 21 and 22 are folded upright to construct the box, folds about the diagonal line 44 to face the adjacent area of the same flange section. When the flange sections 34 and 35 are folded inwardly and secured to the side panels 24 and 25, segments 45 are then folded about fold line 43 so the can be secured by suitable means such as by an adhesive to the outside flange section 36 connected to the bottom panel 23. A continuous, seamless junction is thereby formed between the margins of the bottom panel 23 and the front, rear, and side flanges and the corners therebetween to minimize fluid leakage during the compacting process.

To facilitate folding the assembled box 16 into a collapsed state, a continuous medial fold line 50 is provided along the entire length of the elongated main section 30, crossing the front, rear, and bottom panels 21, 22, and 23, respectively. A pair of diagonal fold lines 51 and 52 are provided on each of the front and rear panels 21 and 22 which extend from the lower corners of the panels to a common point on the medial fold line 50 on each of the panels. This construction facilitates the inward folding of the front panel 21 and rear panel 22 about the medial fold line 50 and the outward folding of the bottom panel 23 about the medial fold line 50 when the box 16 is folded into a collapsed condition for storage.

The assembled box 16 is shown in a partially opened state in FIG. 4. To completely open up the box 16, the inwardly folded front panel 21 and the rear panel 22 are pushed inwardly at corners where the medial fold lines 50 are located, as indicated by the arrows, to force the front and rear panels 21 and 22 to open completely and thereby force the side panels 24 and 25 outwardly. When the box 16 is placed within the trash compactor chamber 14 as shown in FIG. 2, there is a tendency for the front and rear panels 21 and 22 to remain folded slightly inwardly. However, when the box 16 is pushed into the chamber 14, the rear panel is pushed against the rear wall 60 (shown in FIG. 6) to thereby fully open the rear panel and when the door 15 is closed, the inside surface of the door 15 urges the front panel 21 to a fully open position. At least one of the side panels of the box 16 is provided with a free-standing edge 56 which is adapted to be seated in the guide or securing element 57 on the wall of the compacting chamber 14. In this manner, the box 16 is properly aligned within the compacting chamber 14 to avoid contact with the downwardly moving compacting platen 55 during compaction, as shown in FIG. 6. If desired, the free-standing edge 56 may be part of the closure flap 29.

An alternative embodiment of the compactor box of the invention is shown in FIGS. 8 and 9. The box 70 of this embodiment is formed from blanks having essentially the same outline as those shown in FIG. 5 for the box 16. The only difference is the location of the fold lines. In this embodiment, the bottom panel 23 is provided with two pairs of fold lines 72 and 73 and 74 and 75. Each pair of fold lines extends from the corners of the bottom panel 23 to a common point on the medial fold line 50. No diagonal fold lines are provided on the front panel 21 and rear panel 22. This construction allows the bottom panel 23 to fold inwardly (downwardly) about the medial fold line 50 and the front panel 21 and rear panel 22 to fold outwardly about the medial fold line 50, as shown in FIG. 8.

The boxes 16 and 70 generally are assembled in the same manner. The side panels 24 and 25 are first secured by adhesive or other suitable means to the inside of flange sections 36 which are attached to the side margins of the bottom panel 23, the side panels are raised to an upright position by folding the flange section 36 about fold line 42. The front panel 21 and rear panel 22 are then folded upwardly about fold lines 32 and 33, respectively, and flange sections 35 and 36 attached to the side margins of these panels are secured to the outside of side panel 24 and 25 by suitable adhesive or other means. Then front and rear panels 21 and 22 are folded into an upright position and the flange sections 34 and 35 are glued to the side panels 24 and 25. The triangularly shaped portion 45 of the flange sections 34 and 35 extends outwardly and must be secured to the outside of the flange section 36.

The closure flaps 26–29 are preferably folded downwardly and secured against the outside of the front, rear, and side panels by a small amount of adhesive so that when the box 16 or 70 is to be closed, the closure flaps can be easily pulled away from these panels with very little damage thereto.

For storage, the completely assembled boxes 16 and 70 collapse by pressing the side panels 24 and 25 together. When the box 16 is collapsed, the front and rear panels 21 and 22 fold outwardly about medial fold line 50 and the bottom panel 23 folds inwardly (upwardly) about medial fold line 54, whereby when box 70 is collapsed the front and rear panels 21 and 22 fold inwardly about medial fold line 50 and bottom panel 23 fold outwardly (downwardly) about medial fold line 50.

The opened trash containers 16 and 70 are placed within the compacting chamber with the free-standing edge 56 thereof interfitting the overhanging guide or securing means 57 on chamber wall 58, as shown in FIGS. 2 and 3. With box 16, the front and rear panels 21 and 22 are pushed inwardly when the compactor door 18 is closed to ensure that the box is completely open and that it fills the chamber 14 completely and is properly aligned with the platen 55. If desired, another guide means can be mounted on the chamber wall opposite chamber wall 58.

With box 70, folded corners of the outwardly folding front and rear panels 21 and 22 must be pushed outwardly and the bottom panel 23 pushed upwardly to open the box. When the box 70 is installed into the chamber 14 with the free-standing wall interfitting the guide means 56, the bottom panel 23 is pushed upwardly by the bottom 76 of the chamber 14. Additional means may be provided on the inside of the door 15 and the back wall 60 of the chamber 14 to ensure that the front and rear panels 21 and 22 do not fold outwardly (the folded corner moves inwardly) and interfere with the stroke of the compactor platen 55.

The trash compactor 10 is actuated by pressing switch 77 on the control panel 12. This actuates the downward compacting stroke of the platen 55. Upon the completion of the stroke or whenever a predetermined maximum pressure is reached, the platen 55 withdraws. For further details of a preferred compactor, reference is made to copending application Ser. No. 781,391, filed Sept. 28, 1985, which is hereby incorporated herein in its entirety by reference.

Upon completion of compaction, the compactor door 15 is opened by actuating latch 17, the trash box 16 or 70 removed and a new one replaced in the chamber 15. The closure flaps 26–29, which are usually lightly glued to the sides of the box, are pulled away therefrom and folded over the top of the box where they are secured by tape, adhesive, or the like for subsequent disposal.

It is obvious that various modifications and improvements can be made to the present invention without departing from the scope thereof. For example, while the side panels 24 and 25 are described herein as separate panels which are secured by adhesive to the inside of flanges 36, it is obvious that the side panels may be integral extensions of the flanges 36, i.e., the entire box could be made from a single piece of cardboard, fiberboard, or other suitable material. Other modifications and improvements can also be made.

What is claimed is:

1. A collapsible box comprising:

a. an elongated main section with a rectangularly shaped bottom panel having front, rear and side margins and upwardly folding, rectangularly shaped front and rear panels having bottom and side margins, the front and rear panels being hingedly connected at their bottom margins to the front and rear margins respectively of said bottom panel;

b. a pair of continuous, inwardly folding flanges having inner and outer margins, with the inner margins thereof connected to the side margins of the front, rear and bottom panels of the main section, each of the inwardly folding flanges having one pair of fold lines extending from the intersection of the front and bottom panels to the outer edge of the flange, and one pair of fold lines extending from the intersection of the rear and bottom panels to the outer edge of the flange, each pair of the fold lines comprising one fold line which extends transversely across the flange, and one fold line which extends diagonally across the flange to thereby define a triangularly shaped flange section which is folded about the transverse and diagonal lines into contact with and secured to an adjacent section of the flange;

c. a pair of opposed upstanding side panels secured to the inner side of at least the portions of the continuous inwardly folding flanges connected to side margins of the front and rear panels so that the inwardly folding flanges are on the exterior of the box; and d. a continuous medial fold line extending longitudinally along the central portion of the main section including the front, rear, and bottom panels to facilitate the folding of these panels when the box is collapsed into a flattened state.

2. The collapsible box of claim 1 wherein the front and rear panels have diagonal fold lines extending from the lower corners of each panel to a common point on the medial fold line thereon to facilitate the inward folding of the front and rear panels about the medial fold lines.

3. The collapsible box of claim 1 wherein the bottom panel has two pairs of diagonal fold lines, each pair of fold lines extending from adjacent corners thereof to a common point on the medial fold line thereon to facilitate the inward folding of the bottom panel about the medial fold line.

4. The collapsible box of claim 1 wherein at least one of the upstanding panels thereof is provided with a free-standing extension which is adapted to fit into a guide means provided on a compacting chamber wall of a trash compactor to thereby fix the position of the panel within the chamber.

5. The collapsible box of claim 1 wherein the side panels are secured to the continuous flanges by means of adhesive.

6. The collapsible box of claim 1 wherein the front, rear, and side panels are provided with closure flaps.

7. The collapsible box of claim 6 wherein the closure flaps are folded against the outside of the panels and secured thereto.

8. The collapsible box of claim 1 wherein the side panels are formed integrally with the flange sections connected to side margins of the bottom panel.

* * * * *